US005953951A

United States Patent [19]

Fujimoto et al.

[11] Patent Number: 5,953,951

[45] Date of Patent: Sep. 21, 1999

[54] METHOD AND APPARATUS FOR MANUFACTURING BENT PRODUCTS

[75] Inventors: Nobuyuki Fujimoto, Toyota; Takeo Muro, Okazaki, both of Japan

[73] Assignee: Toyota Jidosha Kabushiki Kaisha, Japan

[21] Appl. No.: 09/073,872

[22] Filed: May 7, 1998

[30] Foreign Application Priority Data

May 8, 1997 [JP] Japan ..... 9-118184

[51] Int. Cl.[6] ..... B21D 5/01

[52] U.S. Cl. ..... 72/379.6; 72/382; 72/386; 72/389.1; 72/347

[58] Field of Search ..... 72/389.1, 389.2, 72/389.6, 311, 382, 347, 386, 350, 379.6

[56] References Cited

U.S. PATENT DOCUMENTS

| | | | |
|---|---|---|---|
| 4,373,371 | 2/1983 | Liu | 72/379 |
| 5,501,094 | 3/1996 | Mizuta et al. | 72/382 |

FOREIGN PATENT DOCUMENTS

| | | | |
|---|---|---|---|
| 58-96812 | 7/1983 | Japan . | |
| 59-42140 | 3/1984 | Japan | 72/347 |
| 63-97313 | 4/1988 | Japan | 72/389.1 |
| 2-247019 | 10/1990 | Japan . | |
| 3-264116 | 11/1991 | Japan . | |
| 3-294019 | 12/1991 | Japan . | |
| 4-231113 | 8/1992 | Japan | 72/382 |
| 1433-603 | 10/1988 | U.S.S.R. | 29/894.354 |

*Primary Examiner*—David Jones
*Attorney, Agent, or Firm*—Finnegan, Henderson, Farabow, Garrett & Dunner, L.L.P.

[57] ABSTRACT

The invention relates to apparatus and methods for manufacturing a bent product by press bending a malleable material. The bent product is bent along the lengthwise axis and has a bottom wall and at least one sidewall in cross section. The apparatus preferably includes a die having within its surface a recess. The recess is bent along the lengthwise axis. The apparatus also includes a punch that may be inserted into the recess of the die. The die and the punch substantially correspond to each other such that the die and the punch include a first portion having a first bend radius corresponding to a lengthwise bend in the bent product and a second portion having a second bend radius corresponding to a linear region of the bend product. If the first bend radius is smaller than the second bend radius, chamfered faces formed in the die and punch are shallower and narrower in the first bend radius than the second bend radius. This relationship permits the folding of the material within the lengthwise bend region to be completed before the folding of the material by the die and punch regions having the larger bend radius.

10 Claims, 10 Drawing Sheets

METHOD AND APPARATUS FOR MANUFACTURING BENT PRODUCTS

BACKGROUND OF THE INVENTION

1. Field of the Invention

This invention relates to techniques for manufacturing products by inserting one or more punch(es) into one or more elongated recess(es) formed within a die so that a malleable material, such as a metal plate, is deformed into a shape conforming to the shape of the recess(es) in the die.

2. Description of the Related Art

Japanese Laid-Open Patent Publication No. 3-264116 discloses a method for press bending a metal plate. Referring to FIG. 11(A), an example of such a known method is depicted, in which the punch 2 has been fully inserted into the die 4. Such a press 1 has previously been used to manufacture bumpers for automobiles. In this example, press 1 has been adapted for folding both ends of a steel plate W at right angles to a central portion of the steel plate W to thereby form a product generally having a U-shape cross-section. The press 1 includes the die 4 fixed at a predetermined position and the vertically movable punch 2.

The punch 2 extends in a direction perpendicular to the cross-section shown in FIG. 11(A). The punch 2 is bent along the lengthwise axis and therefore has a non-uniform radius of curvature along the length of the punch. FIGS. 11(B) and 11(C) each schematically show the shape of a product deformed by a punch 2 that is bent along the length of the punch. The punch 2 thus includes a generally linearly extending portion having a large or infinite bend radius and another sharply bent portion having a small bend radius. The die 4 also has an elongated recess 4*m* extending lengthwise that corresponds to the shape of the punch 2. The recess 4*m* is formed into a shape corresponding to the shape of the punch 2, so that the punch 2 can be inserted into the recess 4*m*.

The die 4 has a chamfered face 4*f* an opening edge thereof or along the border of an upper face 4*u* of the die 4 and the recess 4*m*. And most significantly, the chamfered face 4*f* has a uniform shape in cross section along the length of the border.

In the press bending operation, the flat plate W is placed on the upper face 4*u* of the die 4, and the punch 2 is then forced downward. As a result, the punch 2 is inserted into the recess 4*m* of the die 4 with the plate W between the recess 4*m* and punch 2. In the process of the punch 2 being fully inserted into the die 4, the plate W is deformed into a shape conforming to that of the punch 2 and the recess 4*m*. Thus, both ends of the plate W are folded approximately at right angles to the central portion of the plate W.

According to this known press-bending technique, the entire plate W is deformed at approximately the same time. For example, as shown in FIGS. 11(B) and 11(C), a generally linearly extending portion or region F (linear region) of the product is deformed approximately in synchronism with a bent region thereof. Throughout this specification, the reference symbol "OU" designates an outer bent region and the reference symbol "IN" designates an inner bent region.

In the linear region F, the length of the material that will ultimately constitute each sidewall of the final product does not change as a result of the press bending operation, as shown in FIGS. 11(B) and 11(C). Thus, the material having length c1 before the press bending operation has the same length c1 after the press bending operation.

On the other hand, in the inner bent region IN, the material is stretched lengthwise during the deformation process to thereby form the sidewall, as shown in FIG. 11(B). More specifically, in the example of FIG. 11(B), the material that will later constitute the sidewall has a length b2 before being deformed. After this material is deformed to create the sidewall, it has a length b1 in the final product, in which the length b1 is greater than the original length b2. Thus, the material in the inner bent regions IN is stretched or expanded from its original state. As a result, this stretched material is subjected to a tensile stress.

In the outer bent region OU an opposite effect is occurring at the same time. In this case, the material in the plate having length a2 before deformation is compressed to form the second sidewall. As shown in the example of FIG.11(C), this material has a length a1 after deformation, in which the length a1 is less than the original length a2. As a result, this compressed material is subjected to a compressive stress.

In this known technique, the entire plate W is deformed approximately at the same time without consideration to the influences of the expansion and compression of the material that will ultimately form the side walls. However, the expansion and compression of the malleable material directly affects the shape of the product. In particular, as shown in FIG.10(C), wrinkles J may form in the outer bent region OU as the result of the compression of the material. Further, the sidewalls in the inner bent region IN may have a lower height than the sidewalls in the linearly extending regions, because the material in region IN is stretched lengthwise during the deformation process.

SUMMARY OF THE INVENTION

Therefore, one object of the present invention is to provide a method for deforming a malleable material, in which the malleable material can be shaped in a manner that reduces tensile and compressive stresses in the final product, which stresses result from non-uniformity of the bend radius of a punch.

Another object of the invention is to provide an apparatus that can perform the inventive method.

One aspect of the present invention therefore relates to an apparatus for bending a malleable material. This apparatus may be utilized to manufacture a product by pressing a malleable material, such that the final product is bent along the lengthwise axis and preferably has a bottom wall and one or more sidewalls in cross section. The apparatus preferably comprises a die having a recess within the die that is bent along the lengthwise axis to thereby form a final product having a desired shape, and a punch that may be inserted into the lengthwise bent recess of the die. In such a preferred apparatus, the die and the punch are interrelated so that both the die and the punch include corresponding portions bent along the lengthwise direction.

The punch and die have corresponding chamfered faces along the edges of the punch and die. The timing for deforming the malleable material preferably can be adjusted so that the malleable material is bent first by portions of the die and punch that have a smaller bend radius.

The chamfered faces in the portions of the punch and die having the smaller bend radius preferably are designed to be more shallow and narrow than the chamfered faces in the portions of the punch and die that have a larger bend radius. Using this design, the die and punch edges having the smaller bend radius (and therefore shallow, narrow chamfered faces) pinch the malleable material, thereby forcing the pinched material to be deformed first. The regions of the malleable material that are bent by the portions of the die and punch having a larger bend radius, and deeper and wider chamfered faces, thereby complete the deformation process after the regions corresponding to the smaller bend radius.

Thus, the sections of the die and punch having edges with smaller bend radius corresponding to the regions of the final product having a bend along the lengthwise axis of the final product preferably have shallow and narrow chamfered faces. On the other hand, the sections having edges with the larger or infinite bend radius corresponding to the linear or straight regions within the final product preferably have deeper and wider chamfered faces.

Another aspect of the invention relates to a method of press bending a malleable material. In particular, a preferred method is directed to manufacturing a product utilizing a preferred apparatus constructed according to the present invention.

Using a press bending method according to the teachings of the present invention, the material first deforms in a region that is pressed against (or pinched by) the portions of the punch or die having edges with the smaller bend radius, which region(s) is (are) subjected to a large stretch or compression. At this time, the region of the malleable material that is pressed between edges of the punch and die having a large bend radius deform only slightly, as these regions are subjected to little or no deforming pressure in the initial stages of the bending process.

As a result, the malleable material in the region that is pressed between edges of the die and punch having a large bend radius can flow or transfer to or from regions that are being pinched by the small bend radius portions of the punch and die.

Therefore, portions of the malleable material that are most severely stretched during the bending process start to deform in a condition in which additional malleable material can be supplied or drawn from portions of the malleable plate that are being subjected to little or no deforming pressure, such as in the linear regions of the final product.

Also, portions of the malleable material that will be compressed during the bending process start to deform under such a condition that excess material can shift to the portions having a large or linear bend radius. Consequently, tensile stress and/or the compressive stress can be prevented from locally concentrating in the malleable material during the press bending operation, and accordingly, an improved press bending method can be executed.

Further objects, aspects and advantages of the invention will be understood more fully upon reviewing the following description of the detailed description with reference to the drawings and the appended claims.

DETAILED DESCRIPTION OF THE PREFERRED EMBODIMENTS

Figure 1:
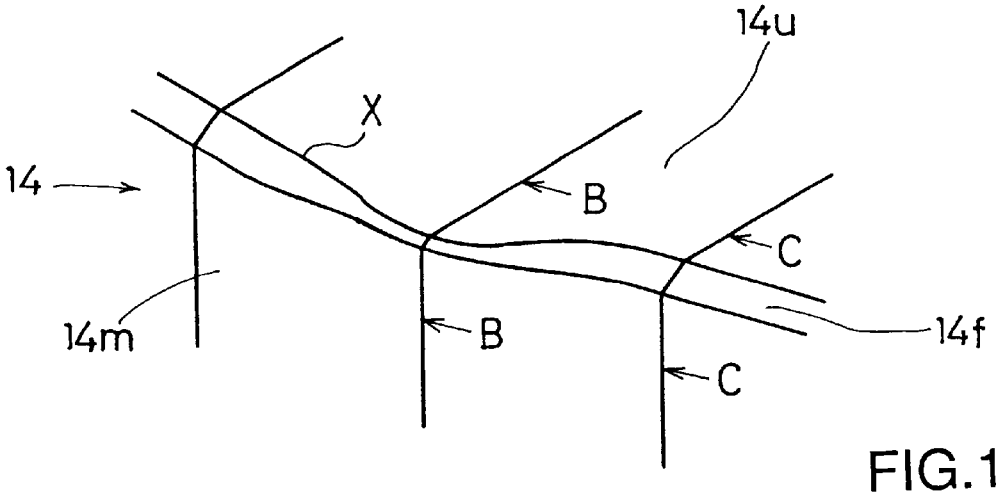
FIG. 1(A) is a partial perspective view of the boundary or border between a surface and a recess of the die used in the press bending apparatus of one embodiment of the present invention.
FIG. 1(B) is a sectional view taken along line B—B in FIG. 1(A)
FIG. 1(C) is a sectional view taken along line C—C in FIG. 1(A)
Figure 1:
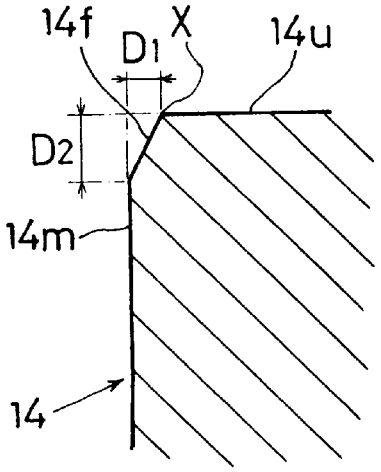
Figure 1:
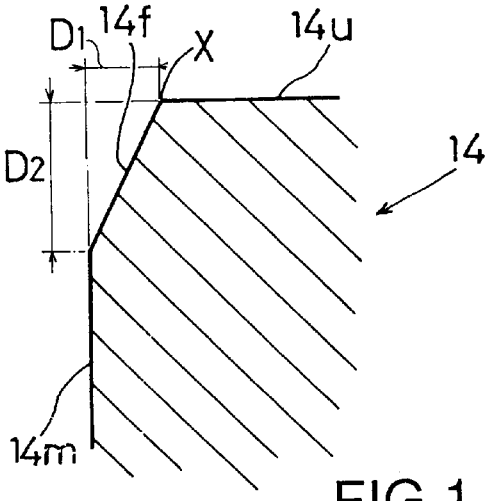
Figure 2:
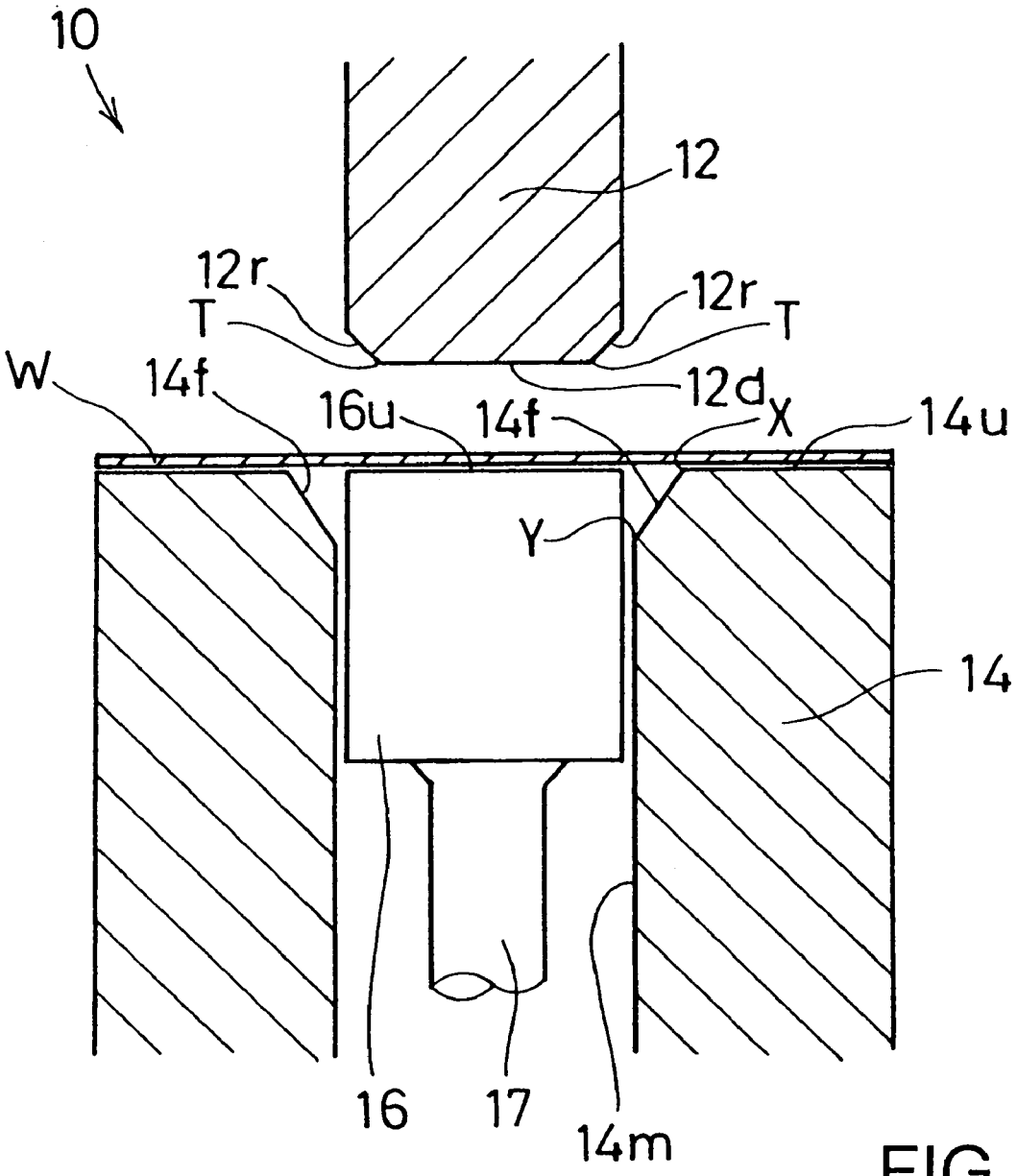
FIG. 2 is a partial longitudinal cross section of the press bending apparatus.
Figure 3:
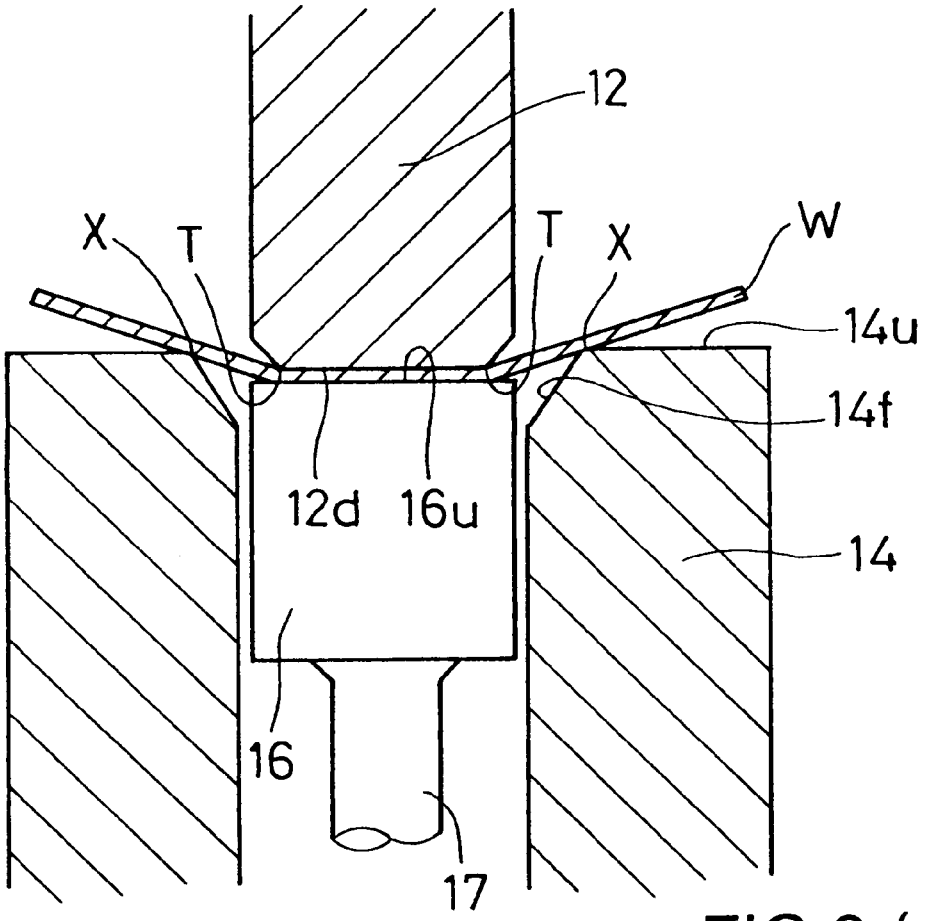
FIGS. 3(A) and 3(B) are partial longitudinal cross-sections of the apparatus, showing a first stage of the press bending method in accordance with the invention.
Figure 3:
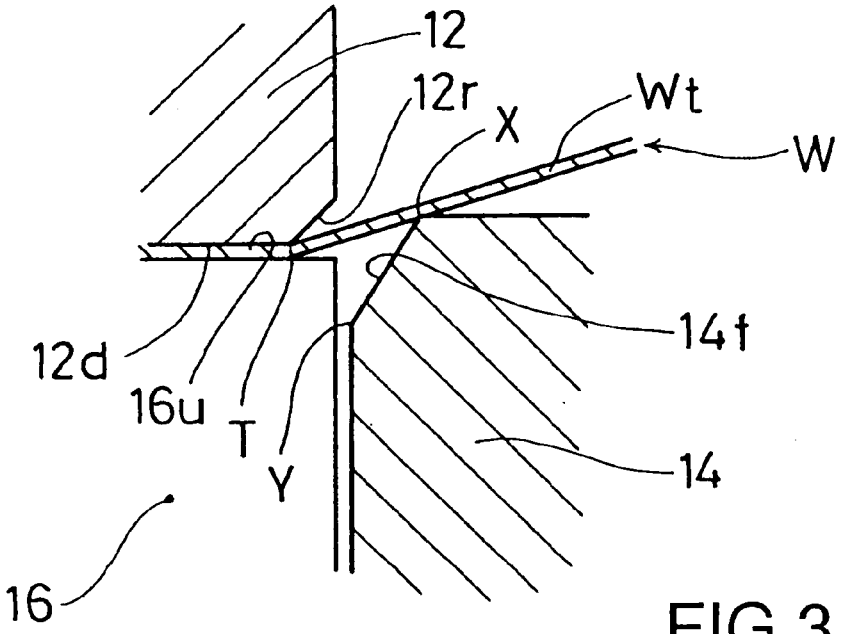
Figure 4:
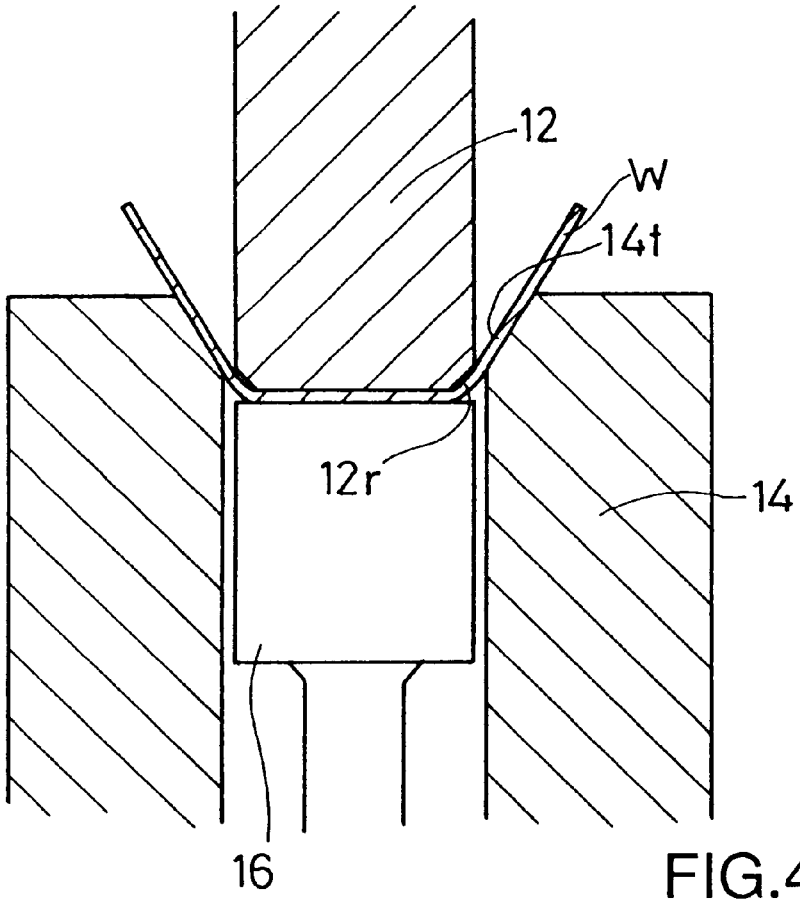
FIGS. 4(A) and 4(B) are partial longitudinal cross-sections of the apparatus, showing a second stage of the press bending method.
Figure 4:
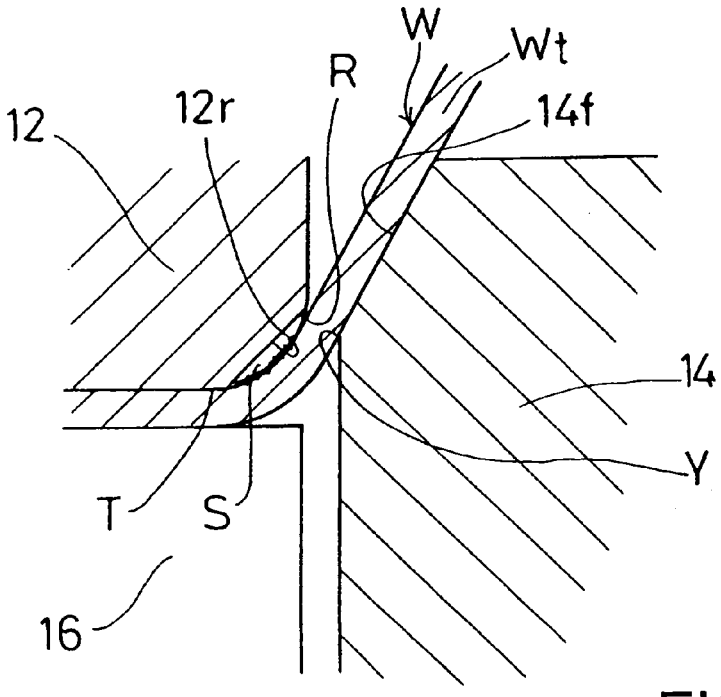
Figure 5:
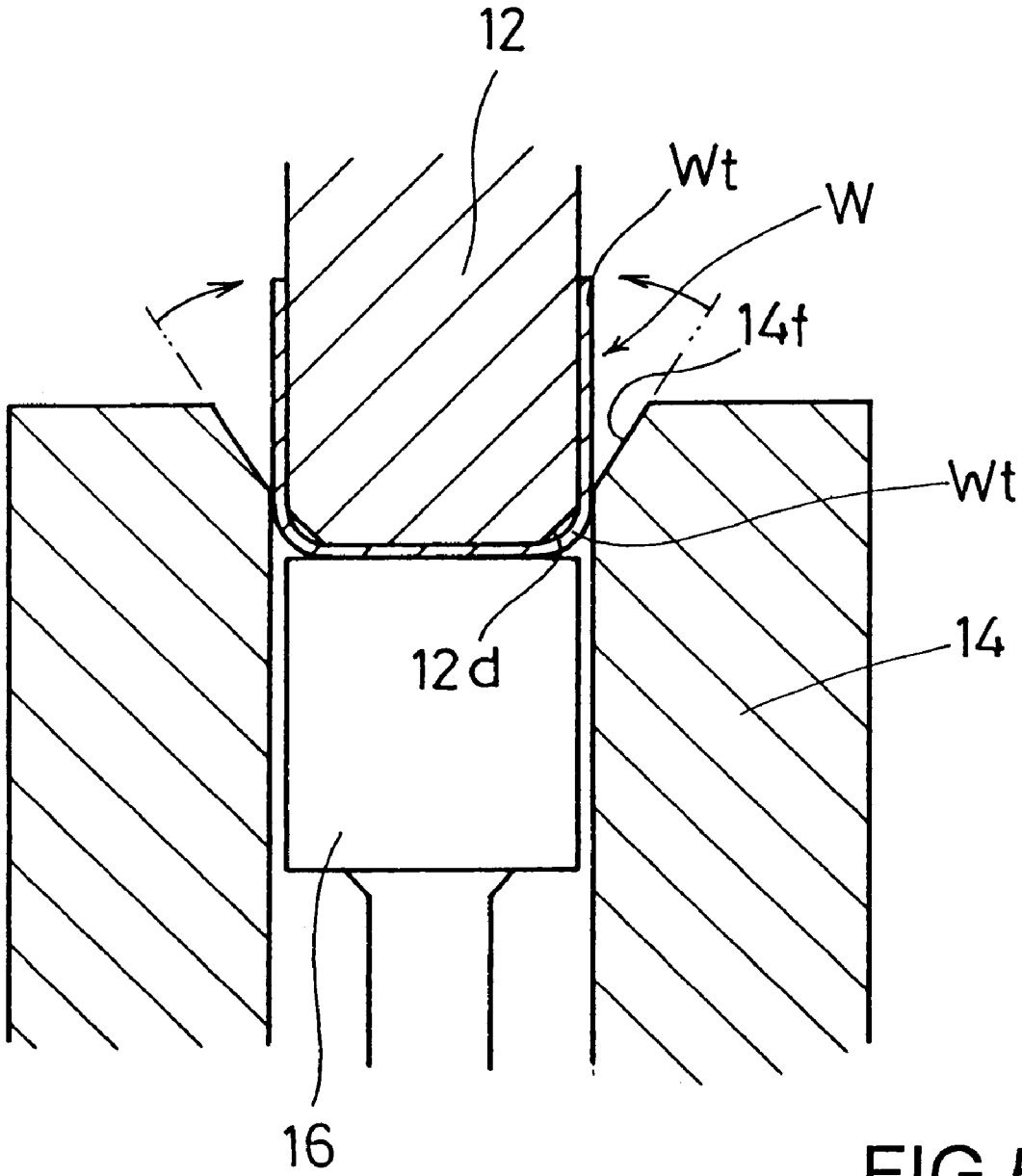
FIG. 5 is a partial longitudinal cross section of the apparatus, showing a third stage of the press bending method.
Figure 6:
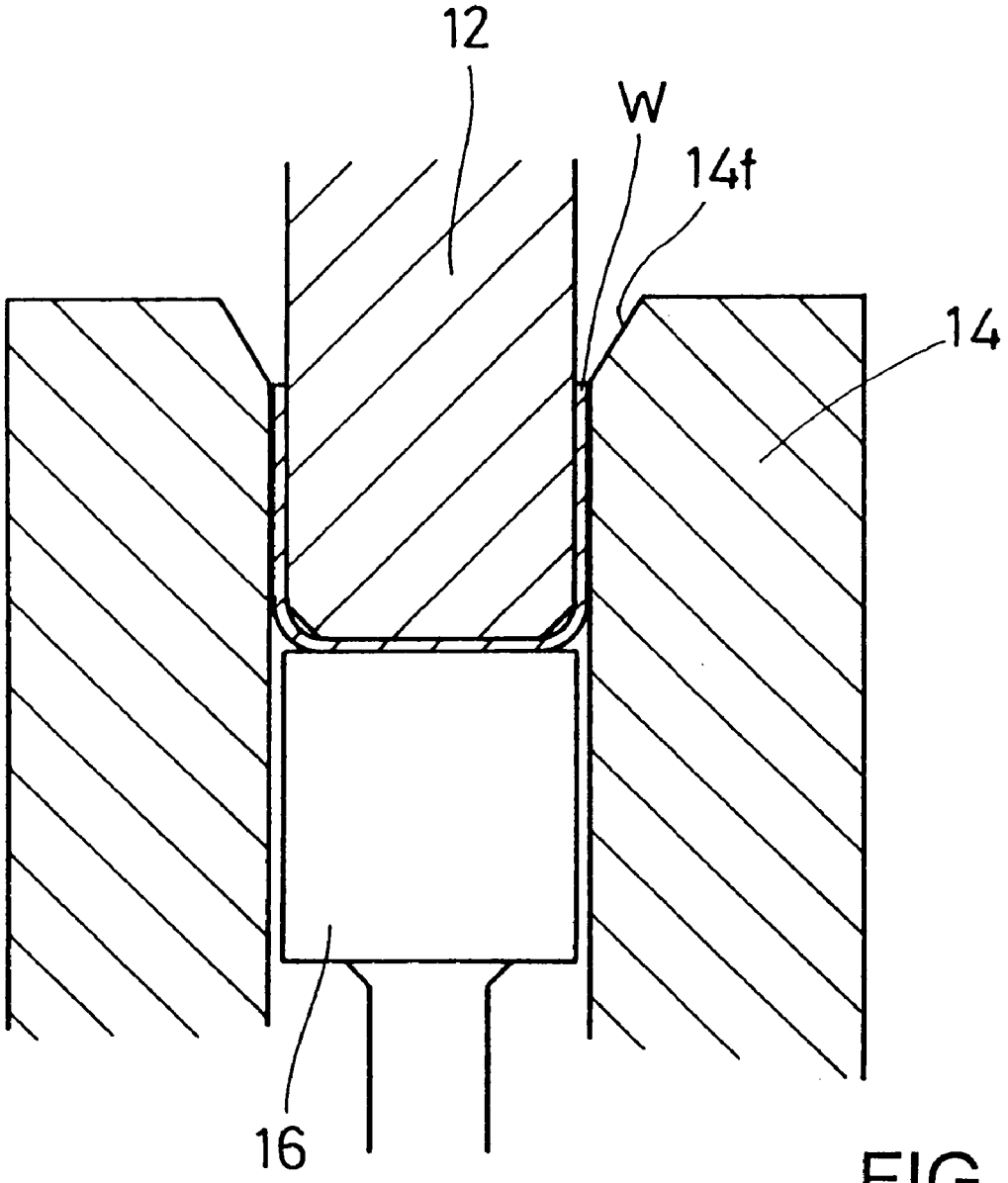
FIG. 6 is a partial longitudinal cross section of the apparatus, showing a fourth stage of the press bending method.

Preferred embodiments of the present invention will be described with reference to FIGS. 1(A) to 9(C). Referring to FIG. 2, one preferred press bending apparatus 10 of the present invention is shown. The press 10 is adapted for folding opposite ends Wt of a malleable plate W (see FIGS. 5 and 7) approximately at right angles to a central portion of the plate thereby forming a product (see FIG. 9) having a generally U-shape cross-section. The press 10 comprises a vertically movable punch 12 and a die 14 fixed at a predetermined position.

The plate can be any malleable material, although preferably the preferred apparatus and methods are utilized to deform metal plates. Also, while most of the drawings and detailed description teach preferred embodiments for making two right angle folds in the plate W, a punch and die according to the present invention may be constructed to make a single right angle fold in the plate. In addition, the fold angle need not be 90 degrees for practicing the present invention.

In particular, a method of bending the product along the lengthwise portion of the final product is shown, for example, in FIG. 9(A). Preferably, the bends along the lengthwise portion are between 90° and 180° or 180° and 270°, although a variety of bend angles are possible according to the present teachings.

Throughout this specification, the term "fold" or "folded" is intended to refer to the folding of the outside edges of the malleable material during the deformation process, as shown for example in FIGS. 9(B) and 9(C). The term "bend" or "bending" refers to the bending of the final product along a lengthwise axis, as shown for example in FIG. 9(A). In either case, the fold or bend is not required to be a sharp crease or a 90° bend. A variety of angles and curvatures to the bend angle or fold angle are permissible with the present invention. Also, the terms "press bending apparatus" and "press bending method" are intended to cover a machine and method for folding and bending a malleable material into a bent product.

In the preferred embodiments, the lengthwise bends are performed by sections of the punch and die that have a smaller bend radius than the sections of the punch and die that will bend the linear regions of the final bent product. The narrow and shallow chamfered faces within the small bend radius of the punch and die pinch the malleable material in the initial stage of the bending process, which pinching action thereby requires those pinched portions of the malleable material to stretch or compress first. Excess malleable material can flow to or from the inner or outer bend regions as is necessary to alleviate compressive or tensile stresses.

Referring again to FIG. 2, the punch 12 is constructed having a thick plate-like shape according to a desired shape of the product to be formed by the press 10. Two more punches may be utilized, although a single punch will be discussed for the purposes of simplicity.

The punch 12 preferably includes a flat bottom side or distal end face 12*d* and two corners at which the plate W is folded. Each corner is chamfered into an inclined face 12*r*. Adjacent to the inclined faces 12*r*, the punch preferably has a pair of side walls. An upper portion (not shown) of the punch 12 is connected to the press 10, for example, via a punch holder (not shown) or a ram (not shown) of the press 10, so that the punch 12 is moved upward and downward upon upward and downward movement of the ram. The punch 12 extends in a direction perpendicular to the cross-section shown in FIG. 2. And as shown in FIG. 9(A), the punch 2 preferably has a non-uniform radius of curvature along its length.

As shown in FIGS. 1(A) to (2), the die 14 preferably includes a flat top face 14*u* and a recess 14*m* into which the punch 12 is inserted, as will be described in greater detail below. Each opening edge (the border of the top face 14*u* and the recess 14*m*) of the recess 14*m* preferably is chamfered into an inclined face (chamfered face) 14*f*. As shown in FIGS. 1(B) and 1(C), the chamfered or inclined face 14*f* is defined to have a width D1 and a depth D2.

As discussed above, the width and depth of these faces may be set to be deeper or broader in a section of the die 14 in which the opening edge thereof extends lengthwise substantially linearly (see FIG. 1(C)). On the other hand, the width and depth of the faces may be set to be shallower or narrower in a section of the die 14 in which the opening edge is bent lengthwise (see FIG. 1(B)).

Figure 7:
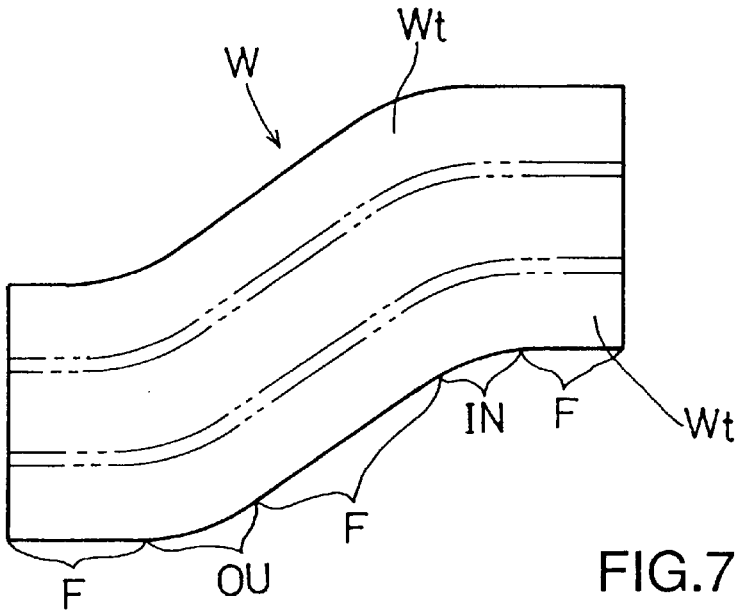
FIG. 7 is a plan view of the plate before press bending.
Figure 8:
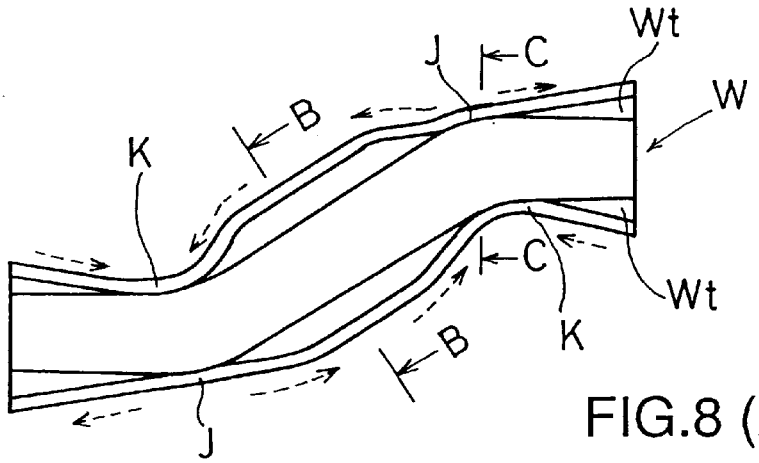
FIG. 8(A) is a plan view of the plate during press bending.
FIG. 8(B) is a sectional view taken along line B—B in FIG. 8(A)
FIG. 8(C) is a sectional view taken along line C—C in FIG. 8(A)
Figure 8:
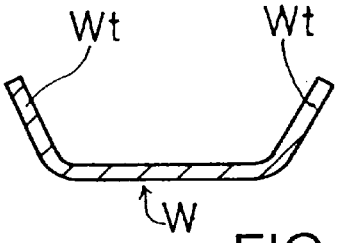
Figure 8:
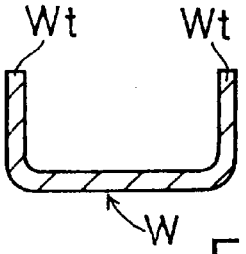
Figure 9:
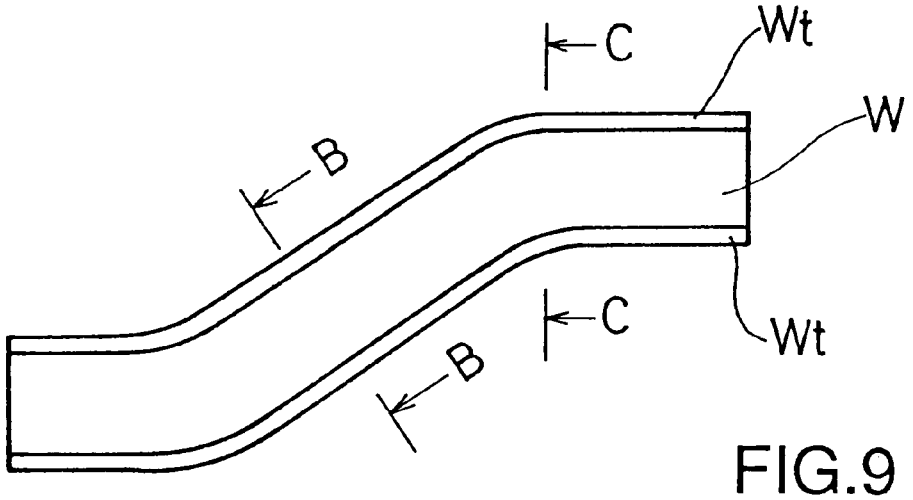
FIG. 9(A) is a plan view of the plate upon completion of the press bending operation.
FIG. 9(B) is a sectional view taken along line B—B in FIG. 9(A)
FIG. 9(C) is a sectional view taken along line C—C in FIG. 9(A)
Figure 9:
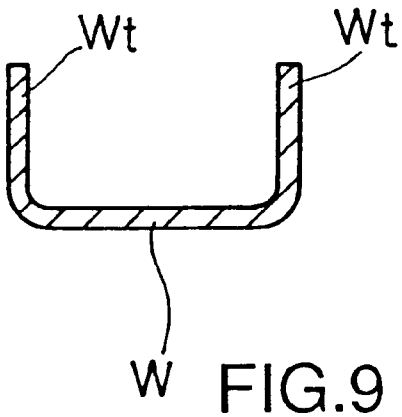
Figure 9:
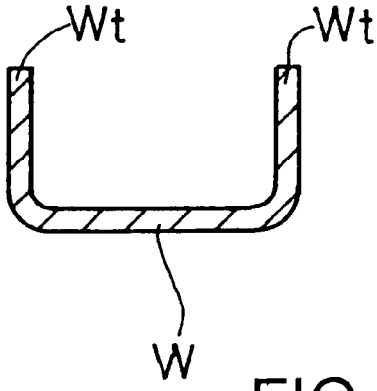
Figure 10:
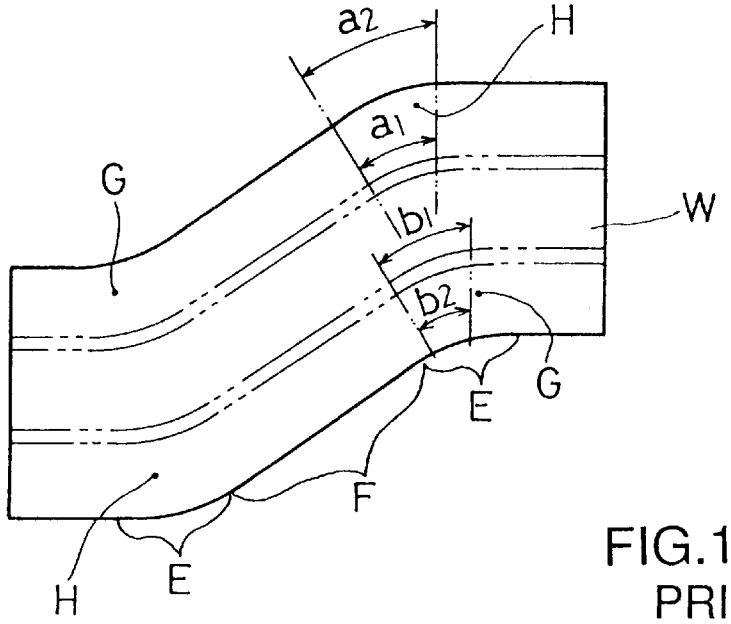
FIG.10 (A) PRIOR ART
FIG. 10(A) is a plan view of the plate before execution of a prior art press bending method.
FIG. 10(B) is a side view of the plate shown in FIG. 10(A)
FIG. 10(C) is a perspective view of the product after execution of the prior art press bending method.
Figure 10:
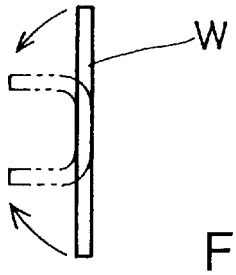
FIG.10 (B) PRIOR ART
Figure 10:
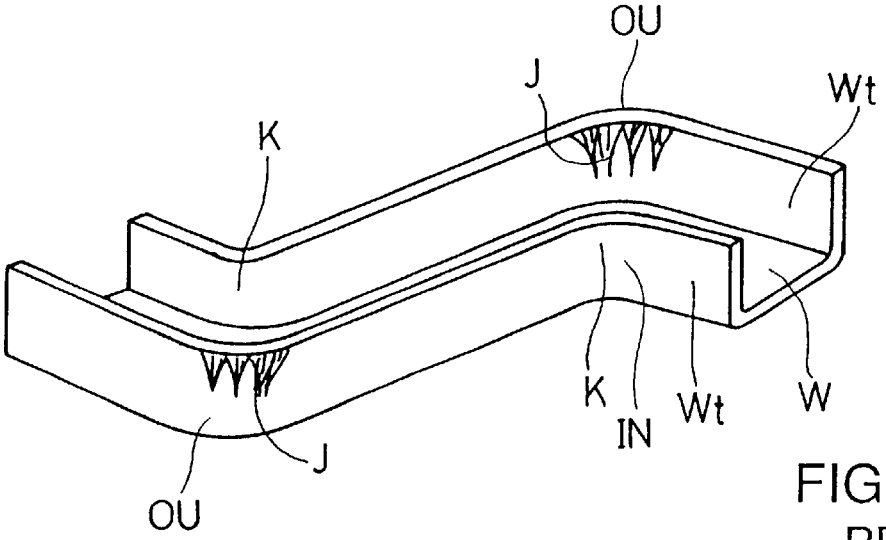
FIG.10 (C) PRIOR ART
Figure 11:
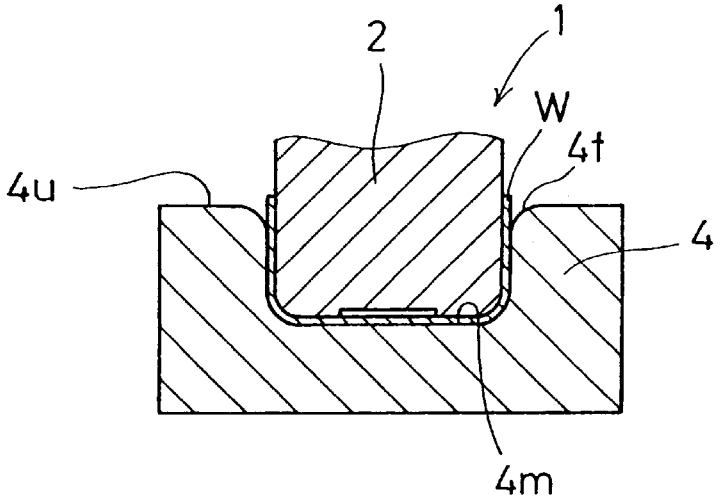
FIG.11 (A) PRIOR ART
FIG. 11(A) is a partial longitudinal section of the prior art press bending apparatus.
FIG. 11(B) depicts a comparison of the plate before and after the prior art press bending technique has been completed to show the stretch of the material in an inner bent region.
FIG. 11(C) depicts a comparison of the plate before and after the prior art press bending technique has been completed to show the compression of the material in an outer bent region.
Figure 11:
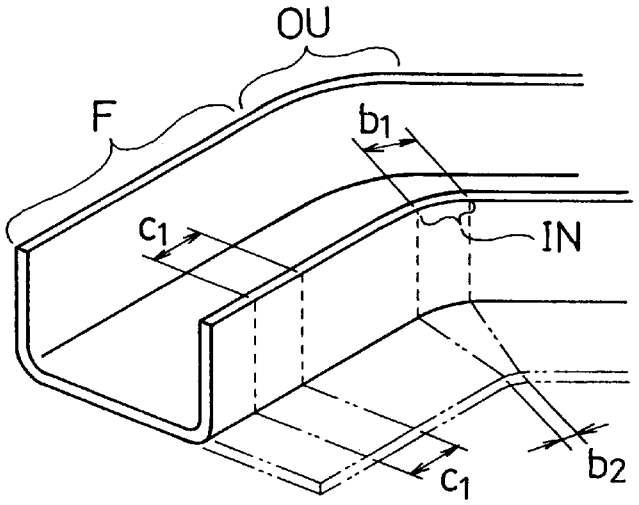
FIG.11 (B) PRIOR ART
Figure 11:
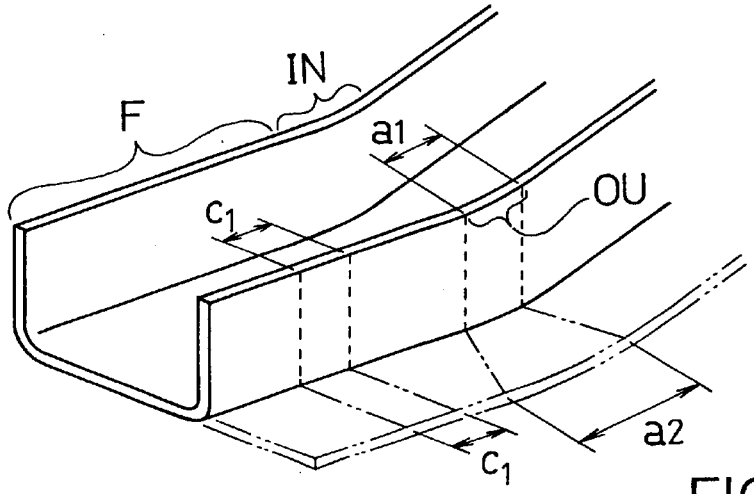
FIG.11 (C) PRIOR ART

In other words, the regions of the opening edge 14*f* of the die 14 and the punch 12*r* that are utilized for folding the plate W with a straight or linear edge (i.e., a region having a large or infinite bend radius, such as the linear region F as shown in FIG. 7) preferably are chamfered to be wider and deeper. Whereas, the regions of the opening edge 14*f* of the die 14 and punch 12*r* that are utilized for bending the bent regions (OU and IN) of the plate W (i.e., the IN and OU bent regions having a smaller bend radius) preferably are chamfered to be narrower and shallower.

As shown in FIG. 2, the die 14 has an edge X formed at the border of the inclined face 14*f* and the top face 14*u*. A clearance defined between the recess 14*m* of the die 14 and the punch 12 is set to be slightly larger than the thickness of the plate W. The recess 14*m* accommodates therein a cushion pad 16 for supporting the plate W. A cushion rod 17 applies a predetermined upward force to the cushion pad 16 during the press bending operation.

As shown in FIG. 7, the malleable plate preferably is cut to accommodate the sections that will constitute the bottom and side wall(s) or the final product, as shown in FIG. 9(A). Preferably, a flat plate is utilized with the present invention. By cutting a flat plate in a manner shown in FIG. 7, trimming is not necessary for the final product. However, a variety of shapes may be utilized for the initial shape of plate W when practicing the present invention.

A preferred method of press bending will now be described with reference to FIGS. 2 to 9(C). First, the punch 12 is held at an upper limit position and the plate W is set on the top face 14*u* of the die 14. The plate W is held horizontally, because an upper face 16*u* of the cushion pad 16 is positioned to be coplanar with the top face 14*u* of the die 14, as shown in FIG. 2. In this state, the punch 12 is moved downward by the operation of the ram. In the process of downward movement, the distal end face 12*d* of the punch 12 abuts the upper surface of the plate W, so that the central portion of the plate W is held by the punch 12 and the cushion pad 16 on opposite sides of the plate W. The punch 12 is then forced to move downward so that the cushion pad 16 is also moved downward, against the upward force exerted thereon by the cushion rod 17, together with the punch 12.

Referring to FIG. 3(A), the opposite ends Wt of the plate W are held by an edge X of the die 14. That is, as the central portion of the plate W is forced downward, the plate W is held by the interaction of edge T of the punch 12 and the cushion pad 16. The plate W is folded along the edges T of the distal end face 12*d* of the punch 12 or the lower edges T of the inclined faces 12*r* (see also FIG. 3(B)). In this operation, the distance between an edge T of the punch 12 and an edge X of the die 14 is shorter in the section of the die 14 in which the width D1 of the inclined face 14*f* thereof is smaller than in the section of the die 14 in which the width D1 is larger. Accordingly, the bent regions (OU and IN) of the plate W begin bending earlier than the linear regions F.

As the press bending method proceeds, the opposite ends Wt of the bent regions (OU and IN) of the plate W abut the upper edges R of the inclined faces 12*r* of the punch 12 earlier than the opposite ends Wt of the plate that correspond to the linear range F. The opposite ends Wt come into face-to-face contact with the inclined faces 14*f* of the die 14 (see FIGS. 4(A) and 4(B)). Upon further downward movement of the punch 12, the opposite ends Wt of the plate W in contact with the inclined faces 14*f* of the die 14 are held between the outer face of the punch 12 (above the point R) and the inner face of the die 14 (below the point Y). Consequently, the opposite ends Wt of the plate W are folded in this example to assume a shape in which the ends Wt are substantially parallel to the side surfaces of the punch 12 and the recess 14*m* (see FIGS. 4(A) to 5).

The chamfered faces 14*f* formed on the opening edges of the groove 14*m* are shallower in the bent regions (OU and IN) of the plate W and deeper in the linear region F thereof. Therefore, the bent regions (IN and OU) of the plate W are bent earlier than the linear region F of the plate W.

FIGS. 8(A) to 8(C) show the press bending operation in which folding and bending is preferably completed in the bent regions IN and OU before folding in the linear region F is completed. Referring to FIG. 8(A), the opposite ends Wt of the plate W in the bent regions IN and OU have been nearly bent into the final shape when downward movement of the punch 12 is nearly completed. As the punch 12 is fully inserted into the die 14, the opposite ends Wt in the linear region F and the opposite ends Wt in the bent regions (IN and OU) are pressed into the clearance between the punch 12 and the die 14, so that the plate W is bent and folded into its final shape.

In this final stage of the inventive process, excess material remaining in a bent outside corner (point J in FIG. 8(A)), that would tend to result in wrinkles and other artifacts in the bent region OU, can flow to the linear regions of the product. On the other hand, a lack of a sufficient amount of material in a bent inside corner (point K in FIG. 8(A)), that would tend to result in local warping in the bent region IN, is alleviated by the flow of material to the inner bent region IN from the linear regions.

That is, when using the present method, the opposite ends Wt of the linear region F of the plate W are still being folded (see FIG. 8(B)) during the final stage of the press bending operation. Therefore, the linear region F is subjected to a tensile stress from the locally warped portion K and a compression stress from the wrinkled portion J, thereby deforming in the direction of the force exerted thereon. These countering forces result in a flow of material between the linear region F and the bent regions (IN and OU) in the process of the bent regions IN and OU being deformed into its final shape.

Dotted arrows in FIG. 8(A) show the movement of material when a malleable material is deformed or shaped according to the present teachings. Wrinkles at point J and local warping at point K, which are typically produced in the opposite ends Wt of the bent regions (IN and OU) for known press bending techniques, are instead absorbed into the opposite ends Wt of the linear region F. This unexpected result is a consequence of the bent regions IN and OU being bent first, such that malleable material can transfer to or from linear region F within the product as is necessary to counteract the tensile and compressive forces. Therefore, the occurrence of wrinkles and/or local warping resulting from either an excess or insufficiency of material in the bent regions (IN and OU) is reduced or eliminated in the wall surfaces Wt, so that the quality of the final bent product can be improved. Furthermore, since the die 14 and punch 12 are not scratched by wrinkles resulting from excess material, damage to the die can be prevented or reduced.

Furthermore, the choice of widths and/or depths of the chamfering edge of the die 14 determines the timing for completing the folding and bending of the opposite ends Wt of the plate W. This design choice can thereby simplify the structure for changing the timing, resulting in an improvement in the reliability and a reduction in the equipment cost.

Although the invention has been applied to press bending the plate W into the U-shape in the foregoing embodiment, the invention may be applied to a case in which the plate is press bent into an L-shape for example.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. An apparatus for manufacturing a product from a malleable material, the product having a bend along a lengthwise axis and a bend along an axis crosswise to the lengthwise axis, comprising:

a die having a surface and a recess formed therein, the recess having a side wall and a bend along a lengthwise axis of the recess which corresponds to the lengthwise bend in the product, the die having smaller and larger bend radii along the lengthwise axis of the recess and a chamfered face between the surface of the die and the side wall of the recess, the chamfered face being shallower in a first portion of the die where it intersects the recess and has the smaller bend radius, and being deeper in a second portion of the die where it intersects the recess and has the larger bend radius; and a punch having a surface, a side wall and a shape corresponding to the lengthwise bent recess of the die, the punch having at least one edge between the surface of the punch and the side wall of the punch.

2. The apparatus of claim 1, wherein the at least one edge of the punch is a chamfered face, the chamfered face being shallower in a first lengthwise bent portion of the punch where it intersects the side wall and has a smaller bend radius than in a second lengthwise portion where it intersects the side wall and has a larger bend radius.

3. The apparatus of claim 1, wherein the chamfered face of the die has a constant inclination over an entire length of the recess, and the chamfered face is shallower and narrower in the first portion where it intersects the recess and surface, respectively, and has the smaller bend radius than in the second portion where it intersects the recess and surface, respectively, and has the larger bend radius.

4. The apparatus of claim 1, wherein the chamfered face of the die is narrower in the first portion where it intersects the surface and has the smaller bend radius than in the second portion where it intersects the surface and has the larger bend radius.

5. A method of manufacturing a product, the product being bent lengthwise and having a bottom wall and at least one side wall in cross section, the method comprising the steps of:

placing a malleable material on a top surface of a die, the die having a recess therein;

pressing a punch against the malleable material to force the malleable material to conform to the shape of the punch and the recess of the die, the malleable material being folded to form at least one side wall that is folded relative the bottom wall, the side wall further being bent along a lengthwise axis of the bent product;

wherein the recess of the die and the punch substantially conform to each other, the recess and the punch including a first portion bent along the lengthwise axis having a first bend radius and a second portion corresponding to a linear region of the product having a second bend radius, the first bend radius being less than the second bend radius; and wherein the pressing step further includes completing the folding of the malleable material with the first portion of the recess and punch having the first bend radius before completing the folding of the malleable material with the second portion of the recess and punch having the second bend radius so as to permit flow of material between the first and second portions.

6. An apparatus for manufacturing a product by pressing a malleable material, the product having a bottom wall extending substantially on a single plane and a pair of side walls folded from opposite ends of the bottom wall approximately at right angles thereto, at least one of the side walls being bent along a lengthwise axis of the product and having a bend radius varying along a portion of the product, the apparatus comprising:

a die having a surface on which the malleable material is placed and a recess formed therein, the recess having at least one bend along a lengthwise axis of the recess, the at least one bend in the recess substantially conforming to the lengthwise bend in the at least one side wall of the product;

a cushion pad disposed within the recess, the cushion pad capable of providing a counter force; and a punch for insertion into the recess, the punch conforming substantially to the shape of the recess and cushion pad;

wherein a border between the surface of the die and the recess is a chamfered face, the chamfered face being narrower and shallower where it intersects the surface and recess, respectively, in a portion of the die corresponding to the lengthwise bend in the at least one side wall of the product than the chamfered face in a portion of the die corresponding to a portion of the at least one side wall of the product that is not bent in the lengthwise direction.

7. The apparatus of claim 6 wherein the chamfered face is shallower in the portion of the die having a smaller bend radius than in the portion of the die having a larger bend radius.

8. The apparatus of claim 6, wherein the chamfered face of the die has a constant inclination over an entire length of the recess, and the chamfered face is shallower and narrower in the portion of the die having a smaller bend radius than in the portion of the die having a larger bend radius.

9. The apparatus of claim 6 wherein the chamfered face is narrower in the portion of the die having a smaller bend radius than in the portion of the die having a larger bend radius.

10. The apparatus of claim 6, wherein the punch has a chamfered face, the chamfered face being shallower in a lengthwise bent portion of the punch having a smaller bend radius than in a lengthwise bent portion of the punch having a larger bend radius.

* * * * *